US012320616B1

(12) United States Patent
Huang

(10) Patent No.: US 12,320,616 B1
(45) Date of Patent: Jun. 3, 2025

(54) QUICK-PULL LEATHER HOLSTER WITH COMPARTMENT AND SINGLE-SIDE LOCK FUNCTION

(71) Applicant: Changhao Huang, Zhuhai (CN)

(72) Inventor: Changhao Huang, Zhuhai (CN)

( * ) Notice: Subject to any disclaimer, the term of this patent is extended or adjusted under 35 U.S.C. 154(b) by 0 days.

(21) Appl. No.: 19/049,019

(22) Filed: Feb. 10, 2025

(30) Foreign Application Priority Data

Oct. 8, 2024 (CN) ..... 202422420313.4

(51) Int. Cl.
*F41C 33/02* (2006.01)
*F41C 33/04* (2006.01)

(52) U.S. Cl.
CPC ..... *F41C 33/0272* (2013.01); *F41C 33/0209* (2013.01); *F41C 33/0263* (2013.01); *F41C 33/041* (2013.01)

(58) Field of Classification Search
CPC .. F41C 33/02; F41C 33/0272; F41C 33/0209; F41C 33/0263; F41C 33/041; F41C 33/0218; F41C 33/0227
USPC ..... 224/911, 244
See application file for complete search history.

(56) References Cited

U.S. PATENT DOCUMENTS

| | | | | |
|---|---|---|---|---|
| 4,925,075 | A * | 5/1990 | Rogers | F41C 33/0245 224/244 |
| 5,419,474 | A * | 5/1995 | Marx | F41C 33/0263 224/244 |
| 5,961,013 | A * | 10/1999 | Collins | F41C 33/0263 224/244 |
| 10,415,928 | B2 * | 9/2019 | Jwszenski | F41C 33/048 |
| 11,686,553 | B2 * | 6/2023 | Foster | F41C 33/0263 224/243 |
| 12,181,247 | B2 * | 12/2024 | McGrane | F41C 33/0263 |
| 2002/0139825 | A1 | 10/2002 | Madarang | |
| 2010/0314423 | A1 | 12/2010 | Kawamoto et al. | |
| 2016/0102940 | A1 | 4/2016 | Sykes et al. | |

* cited by examiner

*Primary Examiner* — Corey N Skurdal
(74) *Attorney, Agent, or Firm* — Hemisphere Law, PLLC; Zhigang Ma

(57) ABSTRACT

A quick-pull leather holster with a compartment and a single-side lock function is provided, relating to the field of leather holsters. The quick-pull leather holster includes a holster main body. A through lock piece is arranged inside the holster main body close to one side thereof. The lock piece is composed of a rigid hollow plastic part and includes: a rivet configured to penetrate through upper and lower sides of the holster main body and to secure the lock piece; a pad positioned between the rivet and an outer side of the holster main body and configured to enhance the securing of the lock piece. The above quick-pull leather holster enhances safety and comfort, which is easy to assemble and can provide protection for a gun, and with which the gun can be pulled out quickly and a higher practicality is achieved.

5 Claims, 6 Drawing Sheets

QUICK-PULL LEATHER HOLSTER WITH COMPARTMENT AND SINGLE-SIDE LOCK FUNCTION

TECHNICAL FIELD

The present disclosure relates to the field of leather holsters, more particularly to a quick-pull leather holster with a compartment and a single-side lock function.

BACKGROUND

Leather holster is a wearable tool that provides portability for a gun. It can be used to store and hide a gun, so that tasks can be carried out more invisibly and effectively and in the face of special circumstances the gun can be quickly pulled out and made ready for use. Therefore, the leather holster has a very high practicality.

At present, the leather holsters available in the market are mainly divided into the types with and without a compartment and the types with and without a lock function. These available products have their own advantages and disadvantages, but they cannot meet the requirements of safety, invisibility, comfort, and quick-pull practicability at the same time. The available leather holsters lack a lock function, resulting in a risk of gun falling off. At present, lock leathers available in the market cite the U.S. Pat. No. 11,686,553B2, belonging to primary locking, where a lock structure is complex in design and large in volume, thus reducing the invisibility and the wearing comfort. Meanwhile, a complex secondary locking device is needed, besides the own primary locking structure of the holster. The leather holsters available in the market basically rely on the primary locking generated by friction. Extra steps or actions in emergent conditions might cause error in pulling out the gun, for example, a thumb releases a button, a hood or a belt. The complexity of a secondary retaining device enhances safety, and extra steps or actions are needed to pull out the gun from the holster. However, the gun cannot be pulled out quickly and there lacks the significance of practicality.

Therefore, the skilled in the art proposes a quick-pull leather holster with a compartment and a single-side lock function to solve the problem mentioned in the above background.

SUMMARY

The present disclosure aims to solve the shortcomings existing in the available technologies and provide a quick-pull leather holster with a compartment and a single-side lock function, which enhances safety and comfort, is easy to assemble and can provide protection for a gun, and with which the gun can be pulled out quickly and a higher practicality can be achieved.

In order to achieve the above aim, the present disclosure provides the following technical scheme. A quick-pull leather holster with a compartment and a single-side lock function includes a holster main body. A through lock piece is arranged inside the holster main body close to one side thereof. The lock piece is composed of a rigid hollow plastic part and includes: a rivet configured to penetrate through upper and lower sides of the holster main body and to secure the lock piece; a pad positioned between the rivet and an outer side of the holster main body and configured to enhance the securing of the lock piece; and an inner ring lock piece positioned inside the holster main body. The inner ring lock piece is in an annular shape, wherein a bottom surface thereof is a flat surface and attached onto a surface of the holster and a top surface thereof is in an arc shape with a higher middle and a lower surrounding. The inner ring lock piece is configured to facilitate a guard ring of a trigger of a gun to slide onto for locking, whereby playing a limiting and securing function.

Further, the holster main body includes a rear holster and a stitched compartment. An inner surface of the rear holster close to an edge is fixedly provided with the lock piece configurable to secure a gun. The stitched compartment is custom-stitched according to a shape of the gun, with the function of immediately preventing the gun continuing moving downwardly when the gun is inserted into the leather holster and slides onto the lock piece, whereby fixing the position of the gun together with the lock piece.

Further, the lock piece is fixed onto the inner surface of the rear holster by means of the rivet penetrating through only upper and lower surfaces of the rear holster.

Further, a front main body is arranged above the holster main body. The front main body includes a front holster. A holster lower opening is formed between rear sides of the front holster and the rear holster, and a holster upper opening is formed between front sides of the front holster and the rear holster. A fixing mechanism is arranged above the front main body close to the front side thereof. The fixing mechanism includes a fixing outer covering, wherein an upper end of the fixing outer covering is provided with a clip.

Further, bending edge areas of the holster main body, the front main body and the fixing mechanism are all fixedly connected by means of stitching. The holster main body, the front main body and the fixing mechanism are all arranged on one same piece of leather.

Working principles: when the holster is being used, a muzzle of a gun is aligned to the holster lower opening before the gun is placed inside from the holster upper opening. When the gun moves downwardly, upon the front end of the guard ring of the trigger slides through the lock piece, the front end of the guard ring of the trigger comes into contact with the stitched compartment immediately, whereby the gun is prevented from continuing sliding downwardly. At this time, the lock piece moves to between the trigger 901 and the guard ring 902 and is accurately fixed between the trigger and the front end of the trigger guard ring to achieve a securing function. When the stitching corner of the stitched compartment comes into contact with the front end of the trigger guard ring, a securing function is achieved that prevents the gun continuing moving. The function of the lock piece is to prevent the gun sliding out of the holster easily, where application of certain force is required to remove the gun from the holster.

When it is needed to pull out the gun, the gun is held in hand to move upwardly. When pulling out the gun by means of an external force, the lock piece passes through the front end of the guard ring of the trigger, whereby unlocking gun. Then, the gun can be pulled out of the holster successfully.

The present disclosure has the following beneficial effects.

1. According to the quick-pull leather holster with a compartment and a single-side lock function provided by the present disclosure, the holster after carrying a gun is fixed on a waist belt by means of the clip, where the rear holster comes into contact with the body. By means of the stitched compartment designed in close contact with the gun, the position of the gun can be effectively limited. The trigger guard ring of the gun is stuck by the single-side lock piece inside the holster, whereby the gun body can be locked and prevented from easily sliding, thus avoiding the complicated unlocking mechanism of the conventional leather lock latches and ensuring quick pull-out of gun. The single-side lock design avoids the problem of the lock leather that the locking is so tight that the gun might get stuck, ensuring quick pull-out of gun and achieving a significance of practicality. Compared to conventional unlocking manners and double-side lock structures, the single-side lock structure is more reliable, where the gun can be pulled out more quickly and several seconds faster can be achieved for the pull-out time of gun.

2. According to the quick-pull leather holster with a compartment and a single-side lock function provided by the present disclosure, the single-side lock structure of the holster is of a small volume arrangement. The lock structure member has a small volume, which can reduce the impact to invisibility and wearing comfort. Meanwhile, the lock piece is fixed by means of a rivet, which avoids the risk of screw loosening to result in a lock failure and achieves a more reliable lock capability. The lock structure is low in assembly difficulty, which can be accurately positioned, and can improve production efficiency and lower production cost.

Legend Explanation:

1, holster main body; 2, fixing mechanism; 3, front main body; 101, rear holster; 102, lock piece; 103, stitched compartment; 201, fixing outer covering; 202, clip; 301, front holster; 302, holster lower opening; and 303, holster upper opening.

41, rivet; 42, pad; and 43, inner ring lock piece.

900, gun; 901, trigger; and 902, guard ring.

DETAILED DESCRIPTION OF THE EMBODIMENTS

The technical schemes of the embodiments of the present disclosure will be clearly and completely described below with reference to the drawings of the embodiments of the present disclosure. Apparently, the described embodiments are merely part embodiments of the present disclosure, rather than all of the embodiments. All of the other embodiments that the ordinary skill in the art obtains on the basis of the embodiments of the present disclosure without paying creative work are intended to fall within the protection scope of the present disclosure.

Figure 1:
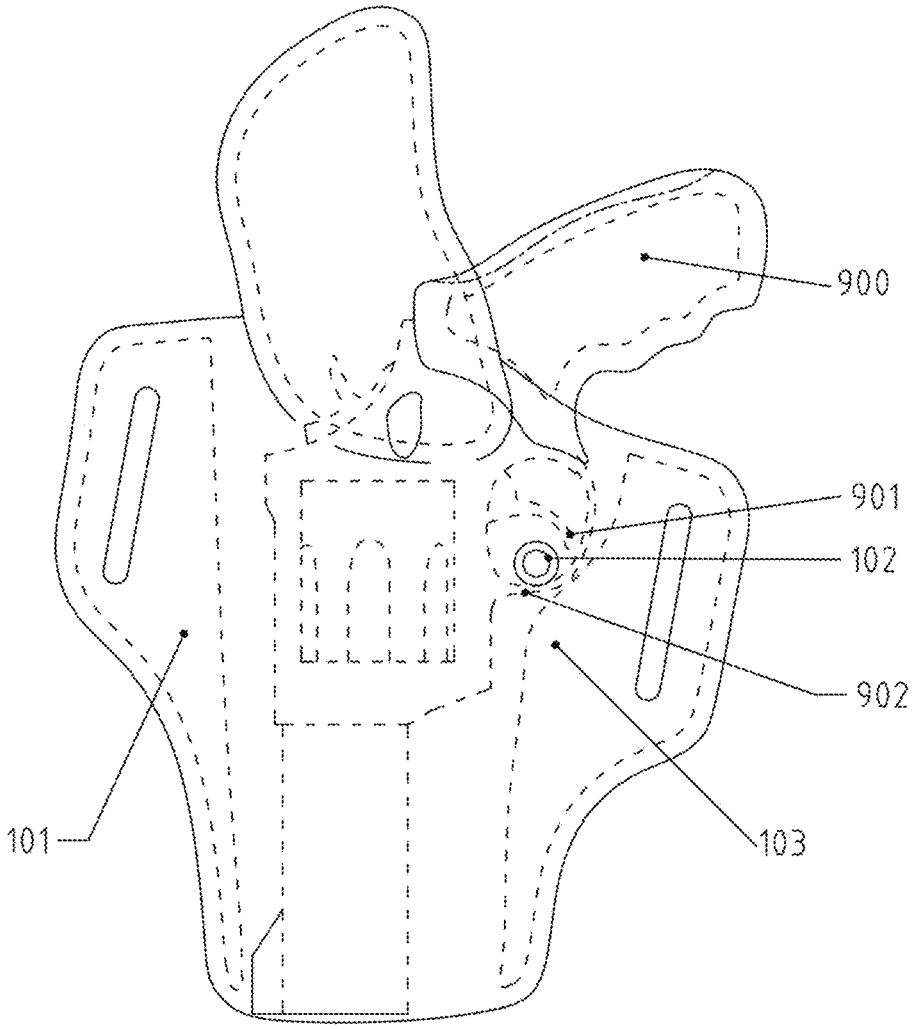
FIG. 1 is a diagram of a gun placed into a holster according to the present disclosure.
Figure 2:
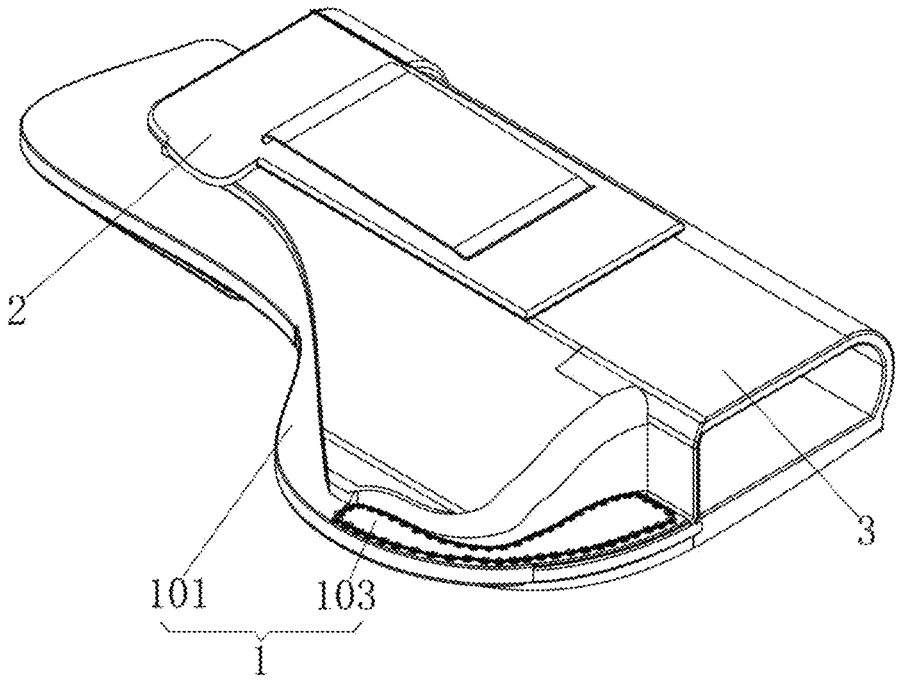
FIG. 2 is a rear axonometric view of an area close to a fixing mechanism of the present disclosure.

Referring to FIG. 2, which is an embodiment provided by the present disclosure, a quick-pull leather holster with a compartment and a single-side lock function includes a holster main body 1. A front main body 3 is arranged above the holster main body 1. A fixing mechanism 2 is arranged above the front main body 3 close to a front side thereof.

In particular, the holster main body 1 and the front main body 3 are stitched into one piece, which is fixed onto a waist belt of a wearer by means of the fixing mechanism 2. As such, the front main body 3 comes into contact with the belt, and the holster main body 1 comes into contact with the body of the wearer. Since the holster is worn between the belt and the body, and due to the limitation by the inner space between the front main body 3 and the holster main body 1, the worn gun has higher invisibility and portability.

Referring to FIG. 1, FIG. 2, FIG. 3 and FIG. 5, the holster main body 1 includes a rear holster 101 and a stitched compartment 103. An inner surface of the rear holster 101 close to an edge is provided with a lock piece 102. The lock piece 102 is a rigid plastic part. The lock piece 102 includes: a rivet 41, a pad 42 and an inner ring lock piece 43.

Figure 6:
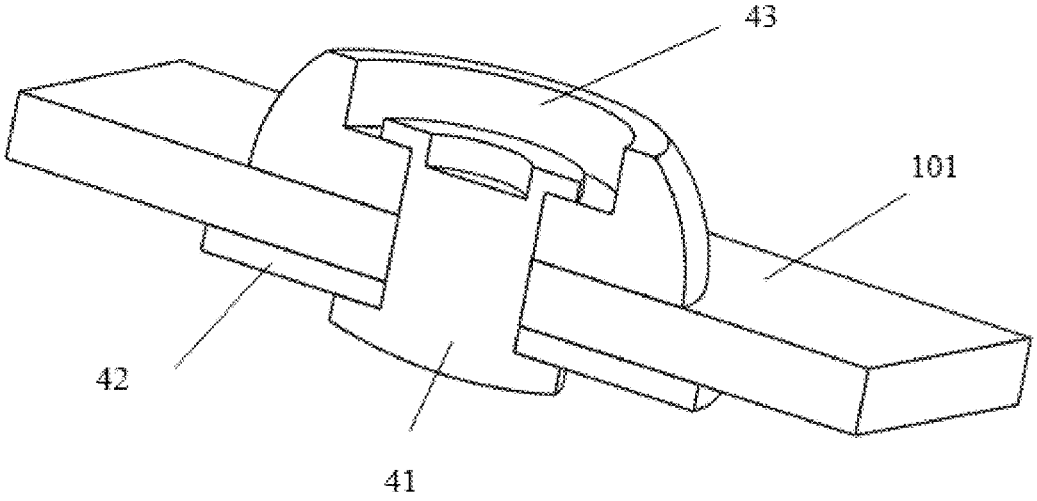
FIG. 6 is a sectional view of a rivet fixing structure of the present disclosure.

Referring to FIG. 6, when the rivet 41 penetrates through only inner and outer surfaces of the rear holster 101, the lock piece 102 can be fixed merely onto the inner surface of the rear holster 101 by means of the pad 42 attached onto the outer surface of the rear holster 101. The rivet 41 is configured to penetrate through upper and lower sides of the holster main body 1 and to secure the lock piece 102.

The pad 42 is positioned between the rivet 41 and an outer side of the holster main body 1 and configured to enhance the securing of the lock piece 102. The inner ring lock piece 43 is positioned inside the holster main body 1. The inner ring lock piece 43 is in an annular shape, wherein a bottom surface thereof is a flat surface and attached onto a surface of the holster and a top surface thereof is in an arc shape with a higher middle and a lower surrounding. The inner ring lock piece 43 is configured to facilitate a guard ring 902 of a trigger 901 of a gun to slide onto for locking, whereby playing a limiting and securing function. In this way, the risk of screw loosening to result in a lock failure is avoided, and a more reliable lock capability is achieved.

In particular, the holster main body 1 includes a rear holster 101 and a stitched compartment 103. The inner surface of the rear holster 101 close to an edge is fixedly provided with the lock piece 102 configurable to secure a gun.

The stitched compartment 103 is arranged at a connection area between the front holster 301 and the rear holster 101 close to the rear side.

In particular, during actual production, it is to be noted that the size of the stitched compartment 103 needs to be designed depending on the shapes of different guns, ensuring a tight contact between the gun and the holster, thereby improving friction and stability. The front main body 3 and the holster main body 1 are consistent in each layer of design and distribution. When a gun is placed inside, the lock piece 102 is positioned between the trigger 901 of the gun and the front end of the trigger guard ring 902, whereby being capable of limiting the movement of the gun under the function of the inner size design and the wearing in manner.

Figure 3:
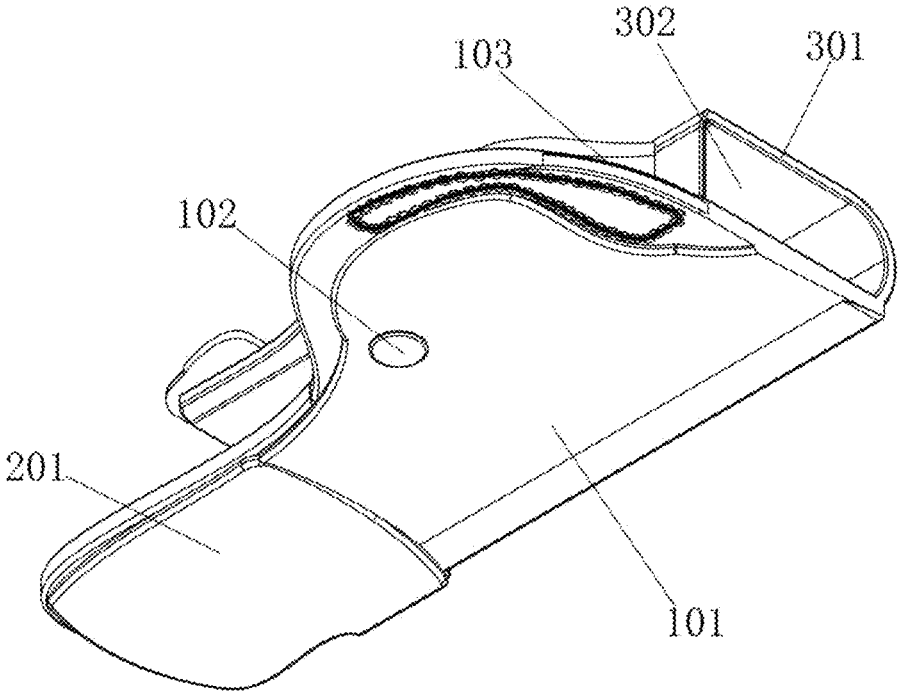
FIG. 3 is a rear axonometric view of an area close to a lock piece of the present disclosure.
Figure 4:
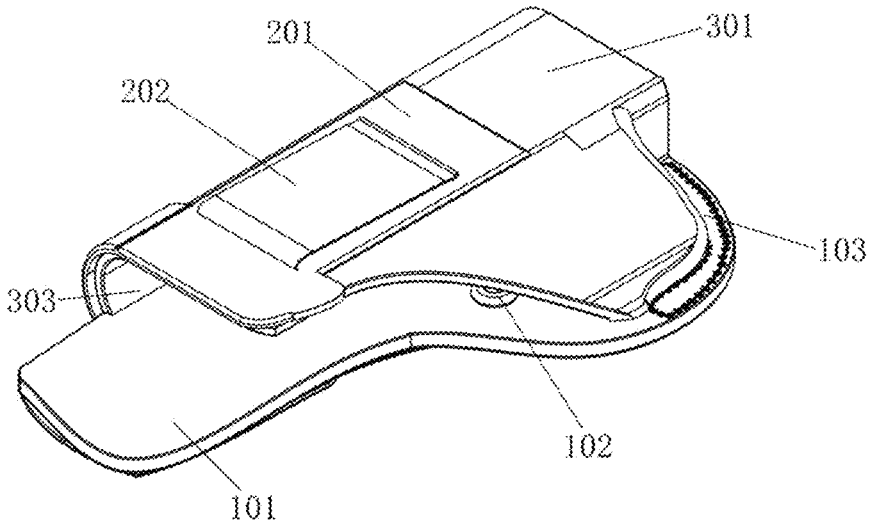
FIG. 4 is a front axonometric view of an area close to a fixing mechanism of the present disclosure.
Figure 5:
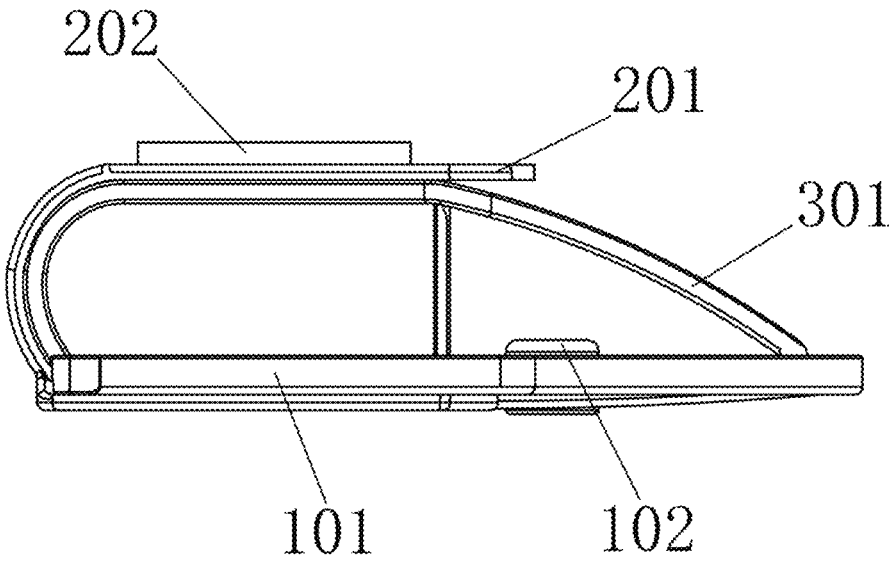
FIG. 5 is a front view of the present disclosure.

Referring to FIG. 2, FIG. 3 and FIG. 4, the front main body 3 includes a front holster 301. A holster lower opening 302 is formed between rear sides of the front holster 301 and the rear holster 101, and a holster upper opening 303 is formed between front sides of the front holster 301 and the rear holster 101. The fixing mechanism 2 includes a fixing outer covering 201, and an upper end of the fixing outer covering 201 is provided with a clip 202.

In particular, a gun is placed inside with a muzzle aligned to the holster lower opening 302, and the clip 202 can be clamped onto a belt, whereby the gun is convenient to carry.

Working Principles:

When the holster is being used, a muzzle of a gun is aligned to the holster lower opening 302 before the gun is placed inside from the holster upper opening 303. When the gun 900 moves downwardly, upon the front end of the guard ring 902 of the trigger 901 slides through the lock piece 102, the front end of the guard ring 902 comes into contact with the stitched compartment 103 immediately, whereby the gun is prevented from continuing sliding downwardly. At this time, the lock piece 102 moves to between the trigger 901 and the guard ring 902, achieving a securing function. When the stitching corner of the stitched compartment 103 comes into contact with the front end of the trigger guard ring 902, a securing function is achieved that prevents the gun continuing moving. The function of the lock piece 102 is to prevent the gun easily sliding out of the holster, where application of certain force is required to remove the gun from the holster.

When it is needed to pull out the gun 900, the gun 900 is held in hand to move upwardly. When pulling out the gun by means of an external force, the lock piece 102 passes through the front end of the guard ring 902 of the trigger 901, whereby unlocking gun 900. Then, the gun 900 can be pulled out of the holster successfully.

By the limitation of the size of the stitched compartment 103 specially designed according to different types of guns, the gun is wrapped up by the inner walls of the front holster 301 and the rear holster 101 perfectly. At this time, the lock piece 102 is positioned inside the trigger guard ring of the gun, accurately fixed between the trigger 901 and the front end of the trigger guard ring 902 to limit the movement of the gun. The design of the compartment can share the lock pressure of the lock piece 102 for the gun, avoiding the lock pressure being completely concentrated on the lock piece 102 at the trigger, whereby reducing the abrasion of the trigger guard ring and protecting the completeness of the gun. When to wear the holster, the front holster 301 may be placed close to a waist belt and then clamped onto the belt by means of the clip 202, at this time the holster 101 comes into contact with the body of the wearer. Since the compartment is designed in a small volume, a good invisibility is achieved when the holster is worn on.

Finally, it should be noted that: the above are preferred embodiments of the present disclosure merely and are not intended to limit the present disclosure. Although the present disclosure has been described in detail by reference to the foregoing embodiments, for those skilled in the art, modifications also can be made to the technical scheme recorded in each embodiment mentioned above, or partial technical features can be substituted equivalently. Any modifications, equivalent substitutes and improvements, etc., made within the spirit and principle of the present disclosure all are intended to be included in the protection scope of the present disclosure.

What is claimed is:

1. A quick-pull leather holster with a compartment and a single-side lock function, comprising a holster main body (1), wherein a through lock piece (102) is arranged inside the holster main body (1) close to one side thereof, the lock piece (102) being composed of a rigid hollow plastic part and comprising:

a rivet (41) configured to penetrate through upper and lower sides of the holster main body (1) and to secure the lock piece;

a pad (42) positioned between the rivet (41) and an outer side of the holster main body (1) and configured to enhance the securing of the lock piece (102); and an inner ring lock piece (43) positioned inside the holster main body (1), the inner ring lock piece (43) being in an annular shape, wherein a bottom surface thereof is a flat surface and attached onto a surface of the holster and a top surface thereof is in an arc shape with a higher middle and a lower surrounding, the inner ring lock piece (43) being configured to facilitate a guard ring (902) of a trigger (901) of a gun to slide onto for locking, whereby playing a limiting and securing function.

2. The quick-pull leather holster with a compartment and a single-side lock function according to claim 1, wherein the holster main body (1) comprises a rear holster (101) and a stitched compartment (103), wherein an inner surface of the rear holster (101) close to an edge is fixedly provided with the lock piece (102) configurable to secure a gun; wherein the stitched compartment (103) is custom-stitched according to a shape of the gun, with the function of immediately preventing the gun continuing moving downwardly when the gun is inserted into the leather holster and slides onto the lock piece (102), whereby fixing the position of the gun together with the lock piece (102).

3. The quick-pull leather holster with a compartment and a single-side lock function according to claim 2, wherein the lock piece (102) is fixed onto the inner surface of the rear holster (101) by means of the rivet penetrating through only upper and lower surfaces of the rear holster (101).

4. The quick-pull leather holster with a compartment and a single-side lock function according to claim 2, wherein a front main body (3) is arranged above the holster main body (1), the front main body (3) comprising a front holster (301), a holster lower opening (302) being formed between rear sides of the front holster (301) and the rear holster (101), and a holster upper opening (303) being formed between front sides of the front holster (301) and the rear holster (101); wherein a fixing mechanism (2) is arranged above the front main body (3) close to the front side thereof, the fixing mechanism (2) comprising a fixing outer covering (201), wherein an upper end of the fixing outer covering (201) is provided with a clip (202).

5. The quick-pull leather holster with a compartment and a single-side lock function according to claim 4, wherein bending edge areas of the holster main body (1), the front main body (3) and the fixing mechanism (2) are all fixedly connected by means of stitching; and wherein the holster main body (1), the front main body (3) and the fixing mechanism (2) are all arranged on one same piece of leather.

* * * * *